US005288251A

United States Patent [19]

Sumida

[11] Patent Number: 5,288,251

[45] Date of Patent: Feb. 22, 1994

[54] CONNECTOR

[75] Inventor: Tatsuya Sumida, Yokkaichi, Japan

[73] Assignee: Sumitomo Wiring Systems, Ltd., Yokkaichi, Japan

[21] Appl. No.: 989,644

[22] Filed: Dec. 11, 1992

[30] Foreign Application Priority Data

Dec. 25, 1991 [JP] Japan ..... 3-106923

[51] Int. Cl.[5] ..... H01R 13/502

[52] U.S. Cl. ..... 439/701; 439/717; 439/752

[58] Field of Search ..... 439/701, 712, 717, 713, 439/752, 709, 710, 715, 714, 723, 724

[56] References Cited

U.S. PATENT DOCUMENTS

| | | | |
|---|---|---|---|
| 3,054,979 | 9/1962 | Buiting | 439/717 |
| 3,273,107 | 9/1966 | Chandler | 439/717 |
| 3,848,951 | 11/1974 | Michaels et al. | 439/717 |
| 4,580,341 | 4/1986 | Chapelot | 439/712 |
| 4,753,614 | 6/1988 | Weiner | 439/717 |
| 4,789,744 | 3/1988 | Bet et al. | 439/717 |
| 5,122,077 | 6/1992 | Maejima et al. | 439/717 |

FOREIGN PATENT DOCUMENTS 3346381 7/1985 Fed. Rep. of Germany .

*Primary Examiner*—Gary F. Paumen
*Assistant Examiner*—Hien D. Vu
*Attorney, Agent, or Firm*—Sughrue, Mion, Zinn, Macpeak & Seas

[57] ABSTRACT

A connector includes a plurality of constituent box-shaped connectors, having flat upper and lower walls, combined with each other by piling the constituent connectors one on the other vertically. A plurality of openings and projections is formed on upper and lower walls of each connector so as to insert each of the projections into each of the openings. As a result, in combining the constituent connectors with each other vertically, each of the projections locks the terminal accommodated in the terminal-accommodating chambers. In this manner, the terminal is double- or triple-locked.

2 Claims, 4 Drawing Sheets

CONNECTOR

BACKGROUND OF THE INVENTION

1. Field of the Invention

The present invention relates to a connector, formed by combining constituent connectors with each other in a multistage, for use in a wire harness of an automobile.

2. Description of the Related Art

With the rapid increase of the installation of electric parts on the automobile in recent years, connectors have been increasingly used to accommodate terminals connected with the wire harness. In this situation, proposals of a multistage connector in which constituent connectors are vertically combined with each other have been made to accomplish an intensive arrangement of connectors.

An example of a conventional multistage connector in which constituent connectors are vertically combined with each other disclosed in Japanese Patent Laid-Open Publication No. 2-148583 is described below with reference to FIGS. 7A and 7B. In order to vertically combine constituent connectors 1, 2, and 3 with each other, the connectors 1, 2, and 3 are slid in a direction as shown by arrows of FIG. 7A by means of guide projections 4 and guide grooves 5 formed on the upper and lower surface thereof, respectively so as to fix the connectors 1, 2, and 3 to each other vertically. Then, a cover 6 is placed on the connector 3, and projections 7 formed on both side surfaces of each of the connectors 1, 2, and 3 are inserted into locking openings **6*b* formed on both side surfaces 6*a* of the cover 6**.

In the above-described multistage connector comprising a plurality of constituent connectors combined with each other, a terminal accommodated in the connector is locked by only a locking portion formed in a terminal-accommodating chamber and the connector have no mechanism for additionally holding the terminal. Thus, when an electric wire connected with the terminal is pulled in combining the connectors with each other by sliding them, there is a possibility that the terminal slips out from the connector.

In addition, it is necessary to slide the connectors 1, 2, and 3 to place them one on the other and then, mount the cover 6 on them in a direction perpendicular to the connector-sliding direction. That is, two-stage operation is required and hence operation efficiency is unfavorable.

SUMMARY OF THE INVENTION

It is an object of the present invention to provide a multistage connector having a mechanism for locking terminals favorably by double-locking or triple-locking them.

It is another object of the present invention to provide a multistage connector in which constituent connectors can be combined with each other without using any parts other than constituent connectors so as to reduce the number of parts other than constituent connectors and manufacturing cost.

It is a further object of the present invention to provide a multistage connector in which constituent connectors can be combined with each other by only pressing an upper connector in one direction so as to improve operation efficiency.

In accomplishing these and other objects of the present invention, there is provided a connector comprising a plurality of constituent box-shaped connectors, having flat upper and lower walls, combined with each other by piling the constituent connectors one on the other vertically, comprising: a plurality of first openings formed on an upper wall of each connector at positions corresponding to an upper surface of each terminal-accommodating chamber arranged in parallel with each other in each connector; a plurality of first projections formed on a lower wall of each connector. In the above construction, in combining the constituent connectors with each other vertically, each of the first projections of an upper connector is locked by each of the first openings of a lower connector and projects into each terminal-accommodating chamber of the lower connector, thus locking an end surface of the terminal.

Further, instead of the above construction or in addition thereto, there is provided a connector comprising a plurality of constituent box-shaped connectors, having flat upper and lower walls, combined with each other by piling the constituent connectors one on the other vertically, comprising: a plurality of second projections formed on an upper wall of each connector at positions corresponding to a portion intermediate between adjacent terminal-accommodating chambers arranged in parallel with each other in each connector or positions corresponding to an end of each terminal-accommodating chamber in the width direction thereof; and a plurality of second openings, into which each of the second projections is inserted, formed on a lower surface of each connector. In the above construction, in combining the constituent connectors with each other vertically, each of the second projections of a lower connector is inserted into each of the second openings of an upper connector and projects into each terminal-accommodating chamber of the upper connector, thus locking a stabilizer of the terminal.

If the engagement between the first opening and the first projection and/or between the second opening and the second projection is tightly made, it is unnecessary to provide a means for fixing the upper and lower connectors to each other. In this case, however, it is necessary to make the dimension of the openings and the projections accurate in manufacturing. In addition, each connector may be provided with locking means because a pressing force is required in fixing the upper and lower connectors to each other.

To this end, preferably, a connector comprises: an arm-shaped rib projecting downwardly from the lower ends of both side walls of each constituent connector except a lowermost connector; a claw projecting inwardly from the lower end of the rib; and a locking portion, for locking the claw, formed on both side walls of each constituent connector. In the above construction, the claw of the rib of an upper connector is locked by the locking portion of a lower connector. Thus, the upper and lower connectors are fixed to each other.

According to the above construction, the terminal accommodated in each terminal-accommodating chamber is locked by the engagement between the first opening and the first projection in combining the upper and lower connectors with each other vertically. That is, the terminal is double-locked by the first projection.

The terminal is also locked by the engagement between the second opening and the second, projection. That is, the terminal is double-locked by the second projection. Therefore, the terminal is triple-locked.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
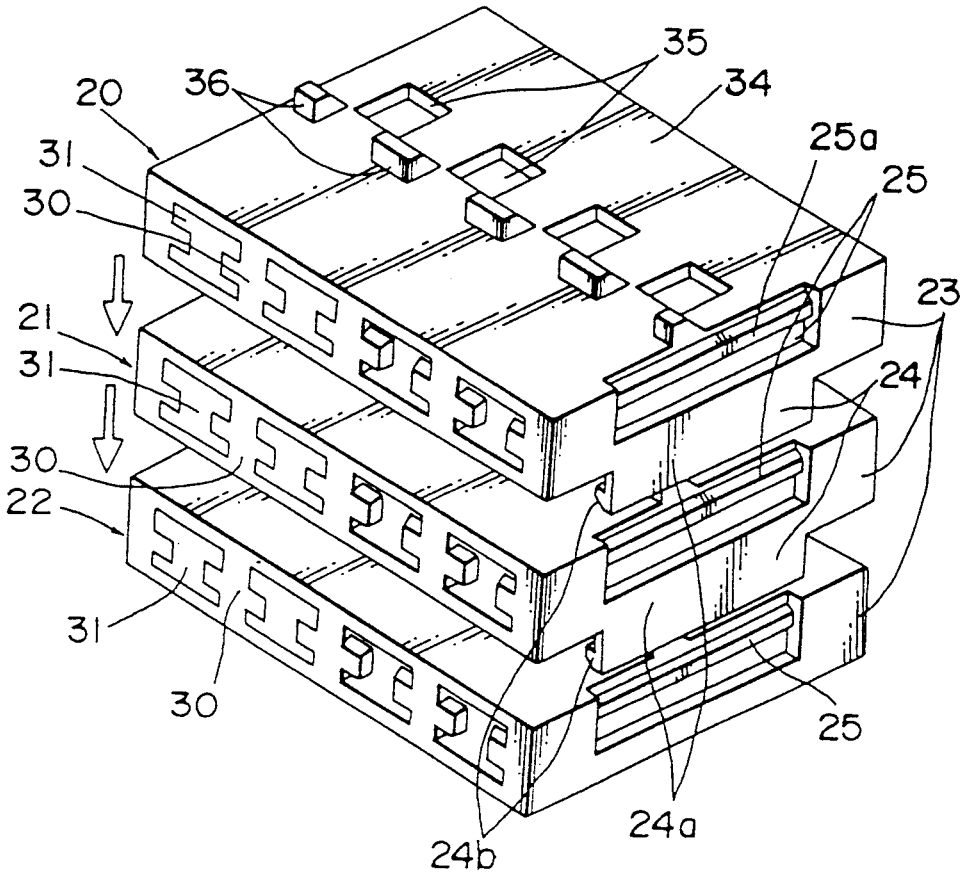
FIG. 1 is a perspective view showing a connector according to an embodiment of the present invention.

Before the description of the present invention proceeds, it is to be noted that like parts are designated by like reference numerals throughout the accompanying drawings.

Referring to FIGS. 1 through 6, a multistage connector in which constituent connectors are vertically combined with each other according to an embodiment of the present invention is described below. As shown in FIG. 1, constituent connectors 20, 21, and 22 are combined vertically with each other to form the multistage connector. The upper connector 20 and the intermediate connector 21 have the same configuration. That is, the arm-shaped rib 24 projects downwardly from a side wall 23 disposed on both sides of each connector and a locking portion 25 is formed in an upper area of the side wall 23 of each connector. The lower connector 22 also has the locking portion 25 formed on the side wall 23 but no rib 24 thereon.

The upper, intermediate, and lower connectors 20, 21, and 22 are box-shaped and have upper and lower walls.

The rib 24 is made of a thin elastic flat plate. The outer surface **24*a* of the rib 24 is flush with the surface 23*a* of the side wall 23 except the front and rear of the side wall 23 of each of the connectors 20 and 21. The rib 24 has a claw 24*b*** projecting inwardly from the lower end thereof.

Figure 3:
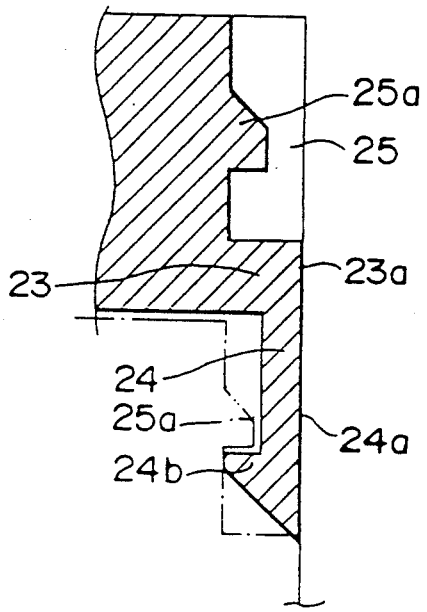
FIG. 3 is a sectional view showing the locking state in which an arm-shaped rib of an upper connector is locked by a locking portion of a lower connector.

As shown in FIG. 3, the locking portion 25 which locks the claw **24*b* is formed from the upper edge of the side wall 23 to the vicinity of the lower end thereof. The longitudinal length of the locking portion 25 is the same as that of the rib 24. The locking portion 25 is formed by stepping the side wall 23 from an upper portion of the side wall 23 to a lower portion thereof to form a projection 25*a* in the center of the locking portion 25. The claw 24*b* is locked by the lower end of the projection 25*a*. The cutting depth of the locking portion 25 and the projection amount of the projection 25*a* are set so that in the locking state, the outer surface 24*a* of the rib 24 is flush with the surface 23*a* of the side wall 23**.

In the construction of the connector in which the rib 24 having the claw **24*b* and the locking portion 25 are formed, the upper connector is pressed downwardly with the upper connector placed on the lower connector. When the claw 24*b* passes the projection 25*a* in its downwardly movement, the claw 24*b* engages the lower end of the projection 25*a***. In this manner, the upper and lower connectors are combined with each other.

Figure 4:
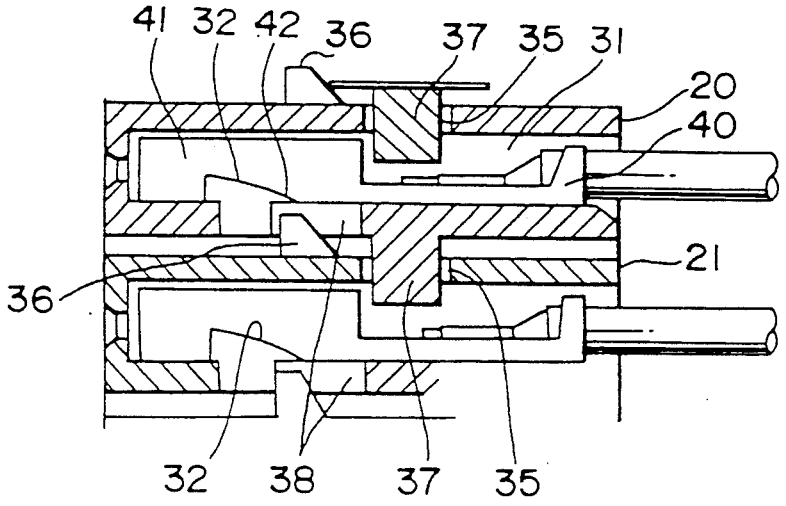
FIG. 4 is a sectional view showing upper and lower connectors combined with each other.
Figure 5:
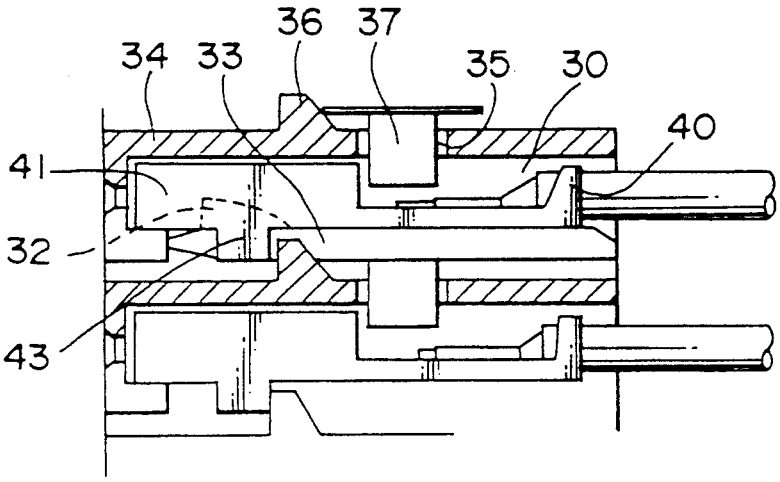
FIG. 5 is a sectional view showing the upper and lower connectors combined with each other.

In the connectors 20, 21, and 22, terminal-accommodating chambers 30 are arranged in parallel with each other with partitioning walls 31 interposed between the adjacent terminal-accommodating chambers 30. As shown in FIG. 4, each terminal-accommodating, chamber 30 has, in a front bottom surface thereof, a lance 32 to be locked by an opening 42 formed on the bottom surface of an electric contact portion 41 of a terminal 40 accommodated in the terminal-accommodating chamber 30. As shown in FIG. 5, the terminal-accommodating chamber 30 has a groove 33 on the bottom surface thereof. Stabilizers 43, which project downwardly from both sides of the electric contact portion 41 of the terminal 40, are inserted into the groove 33.

Rectangular, first openings 35 are formed through the upper wall 34 of each connector at regular intervals at positions corresponding to approximately the center of the terminal-accommodating chamber 30 in the longitudinal direction thereof.

Figure 6:
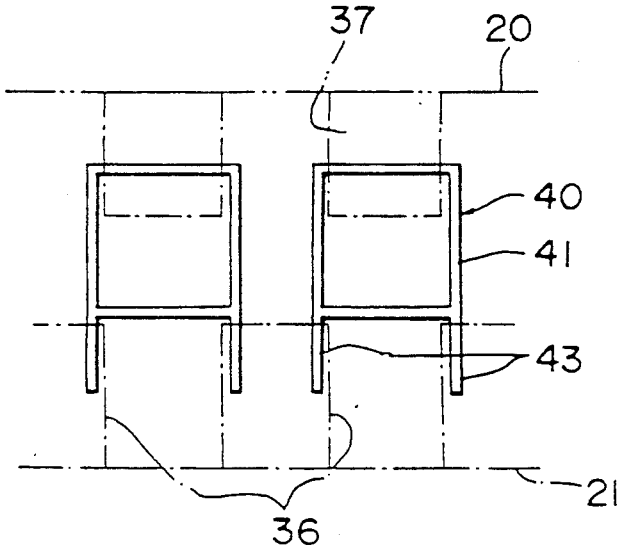
FIG. 6 is a view showing the locking state in which a terminal is locked by projections of the connector.
Figure 7A:
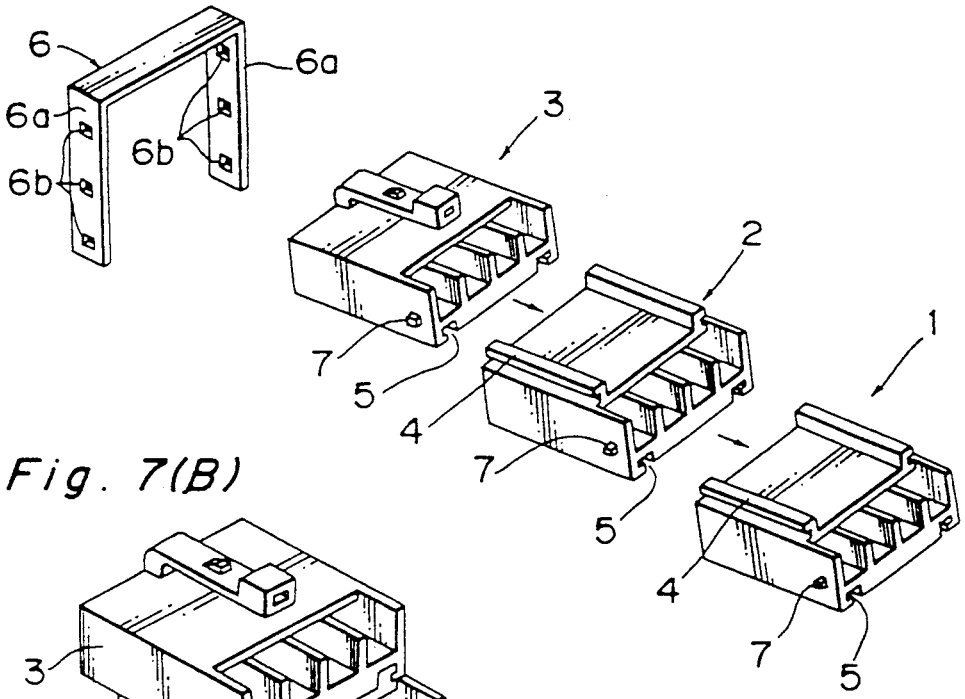
FIG. 7A is a perspective view showing a conventional connector in which constituent connectors are exploded.
Figure 7B:
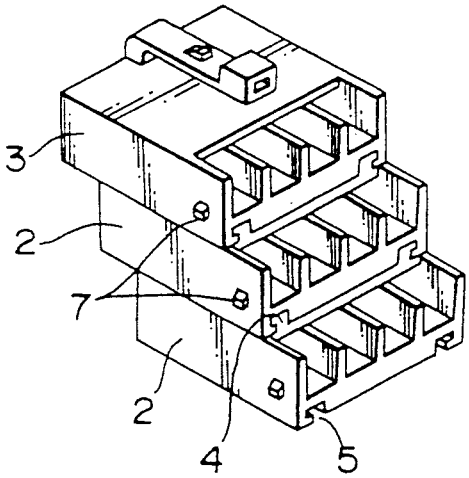
FIG. 7B is a perspective view showing the conventional connector in which constituent connectors are combined with each other.

Second projections 36 are formed upwardly from the upper wall 34 of each connector at positions forward of the first engaging openings 35 in such a manner that the interval between the second projections 36 is the same as that between the adjacent first openings 35. As will be described later, when the second projection 36 projects into the terminal-accommodating chamber 30, both left and right side surfaces of the second projection 36 contact the rear end surface of the stabilizer 43 of the terminal 40 as shown in FIG. 6.

Figure 2:
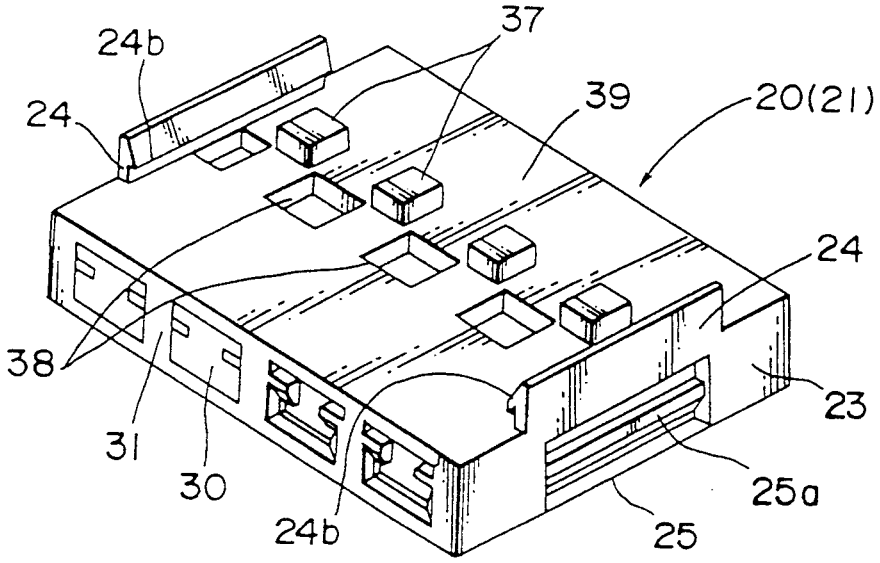
FIG. 2 is a perspective view showing the connector of FIG. 1 turned upside down.

As shown in FIG. 2, rectangular first projections 37 which are to be closely inserted into each first engaging opening 35 of the lower connector are formed on the lower wall 39 of each of the connectors 20 and 21 at positions corresponding to the positions of the first openings 35. The first projection 37 is inserted into the terminal-accommodating chamber 30 from the upper surface thereof, thus locking the rear end surface of the electric contact portion 41 of the terminal 40.

Second engaging openings 38 are formed through the lower surface of each of the connectors 20 and 21 at positions forward of the first projections 37 in such a manner that the interval between the adjacent second openings 38 is the same as that between the adjacent first projections 37. Each second opening 38 is formed at a position at which each second projection 36 formed on the lower connector is inserted thereinto, namely, at a position corresponding to an intermediate portion between the terminal-accommodating chambers 30 adjacent to each other.

According to the above-described construction, as shown in FIG. 1 in particular, in placing the connectors 20, 21, and 22 one on the other, the intermediate connector 21 is placed on the lower connector 22 and then, the connector 21 is pressed downwardly with the first projection 37 projecting from the lower surface of the connector 21 coinciding with the first engaging opening 35 formed through the upper wall of the connector 22. As a result, the first projection 37 is inserted into the first opening 35, and the rib 24 formed on the side wall 23 of the connector 21 coincides with the locking portion 25 of the connector 22. Consequently, the claw 24*b* of the rib 24 is locked by the projection 25*a* of the locking portion 25.

The second projection 36 formed on the upper surface of the connector 22 is inserted into the second opening 38 formed through the lower wall of the connector 21 by only pressing the connector 21 toward the connector 22.

Similarly, the connector 20 is locked by the connector 21 by pressing the former toward the latter.

The terminal 40 accommodated in the terminal-accommodating chamber 30 is triple-locked by the engagement between the first opening 35 and the first projection 37 and between the second opening 38 and the second projection 36. More specifically, the lance 32 formed on the bottom surface of the terminal-accommodating chamber 30 engages the opening 42 formed on the terminal 40. That is, a first locking is accomplished.

The first projection 37 inserted into the first opening 35 projects into the terminal-accommodating chamber 30 from the upper surface thereof at an intermediate portion thereof in its longitudinal direction, thus locking the rear end surface of the electric contact portion 41 of the terminal 40. That is, a second locking is accomplished. The second projection 36 inserted into the second opening 38 projects into a front portion of the terminal-accommodating chamber 30 from the lower surface thereof, thus locking the rear end surface of the stabilizer 43 projecting from both sides of the electric contact portion 41. That is, a third locking is accomplished.

As described above, the first projection 37 and the second projection 36 lock the rear end surface of the electric contact portion 41 and that of the stabilizer 43, respectively. Therefore, unless the terminal 40 is inserted into the predetermined position of the terminal-accommodating chamber 30, the first projection 37 or the second projection 36 is brought into contact with the terminal 40 in combining the upper connector and the lower connector with each other. As a result, the first projection 37 cannot be inserted into the first opening 35 or the second projection 36 cannot be inserted into the second opening 38. In this manner, an incorrect insertion of the terminal 40 into the terminal-accommodating chamber 30 can be detected.

As described above, the mechanism for combining the connectors with each other vertically has a function of detecting whether or not the terminal has been correctly inserted into the terminal-accommodating chamber and of double- or triple-locking the terminal.

That is, in the embodiment described above, the upper and lower connectors are fixed to each other by the engagement between the rib formed on both sides of the upper connector and the locking portion formed on both side walls of the lower connector, and the terminal accommodated in the connector is locked by the engagement between the first opening and the first projection and the engagement between the second opening and the second projection. That is, the terminal is triple-locked. Accordingly, even though tensile force is applied to an electric wire (W) mounted on the terminal under pressure, the locking mechanism prevents the terminal from slipping out from each housing.

Only one locking mechanism may be provided. That is, only the first openings and the first projections may be formed or only the second openings and the second projections may be formed. In this case, the terminal is double-locked including the engagement between the lance formed on the bottom surface of each terminal-accommodating chamber and the opening formed on the terminal.

It is unnecessary to provide the connector with the locking mechanism comprising the arm-shaped rib and the locking portion formed on both side walls of the connector if the engagement between the first openings and the first projections and/or the engagement between the second openings and the second projections is tightly accomplished.

As apparent from the foregoing description, according to the connector, in combining constituent connectors with each other vertically, each projection inserted into each terminal-accommodating chamber locks the terminal. The projection can be utilized to detect whether or not the terminal has been inserted into the terminal-accommodating chamber correctly, and the terminal accommodated in the connector is double- or triple-locked. Thus, the terminal can be reliably secured to the connector.

In addition, constituent connectors are piled one on the other with each projection and each opening formed on the upper surface of the lower connector coinciding with each opening and each projection formed on the lower surface of the upper connector, respectively. Then, the upper connector is pressed downwardly. In this manner, the upper and lower connectors are fixed to each other. That is, they can be combined with each other by only pressing the upper connector downwardly. In addition, no extra parts are required in combining the upper and lower connectors with each other.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A connector comprising a plurality of constituent box-shaped connectors, having flat upper and lower walls and a plurality of terminal accommodating chambers for accommodating terminals, combined with each other by piling the connectors one on the other vertically, comprising:

a plurality of first openings formed on an upper wall of each connector at positions corresponding to an upper surface of each terminal-accommodating chamber arranged in parallel with each other in each connector;

a plurality of first projections formed on a lower wall of each connector, in which:

in combining the plurality of constituent connectors with each other vertically, each of the first projections formed on a lower wall of an upper connector is locked by each of the first openings formed on an upper wall of a lower connector and projects into each terminal-accommodating chamber of the lower connector, thus locking an end surface of a corresponding terminal, and further comprising:

a plurality of second projections formed on an upper wall of each connector at positions corresponding to a portion intermediate between adjacent terminal-accommodating chambers arranged in positions corresponding to an end of each terminal-accommodating chamber in a width direction thereof; and a plurality of second openings, into which each of the second projections is inserted, formed on a lower wall of each connector, in which:

in combining the constituent connectors with each other vertically, each of the second projections formed on an upper wall of a lower connector is inserted into each of the second openings formed on a lower wall of an upper connector and projects into each terminal-accommodating chamber of the upper connector, thus locking a stabilizer of a corresponding terminal, thereby to double-lock each terminal.

2. A connector comprising a plurality of constituent box-shaped connectors, having flat upper and lower walls, a pair of side walls and a plurality of terminal accommodating chambers for accommodating terminals, combined with each other by piling the connectors one on the other vertically, comprising:

a plurality of first openings formed on an upper wall of each connector at positions corresponding to an upper surface of each terminal-accommodating chamber arranged in parallel with each other in each connector;

a plurality of first projections formed on a lower wall of each connector, in which:

in combining the constituent box-shaped connectors with each other vertically, each of the first projections formed on a lower wall of an upper connector is locked by each of the first openings formed on an upper wall of a lower connector and projects into each terminal-accommodating chamber of the lower connector, thus locking an end surface of a corresponding terminal; and a plurality of second projections formed on the upper wall of each connector at positions corresponding to a portion intermediate between adjacent terminal-accommodating chambers arranged in parallel with each other in each connector or positions corresponding to an end of each terminal-accommodating chamber in a width direction thereof; and a plurality of second openings, into which each of the second projections is inserted, formed on a lower wall of each connector, in which:

in combining connectors with each other vertically, each of the second projections formed on an upper wall of the lower connector is inserted into each of the second openings formed on a lower wall of the upper connector and projects into each terminal-accommodating chamber of the upper connector, thus locking a stabilizer of a corresponding terminal; and an arm-shaped rib projecting downwardly from lower ends of both side walls of each constituent connector except a lowermost connector; a claw projecting inwardly from a lower end of the rib; and a locking portion, for locking the claw, formed on both side walls of each constituent connector, in which:

the claw of the rib of the upper connector is locked by the locking portion of the lower connector so as to fix the upper connector and the lower connector to each other.

* * * * *